US006308953B1

(12) United States Patent
Nagano

(10) Patent No.: US 6,308,953 B1
(45) Date of Patent: Oct. 30, 2001

(54) GAMING MACHINE

(75) Inventor: Hiroyuki Nagano, Koutou-ku (JP)

(73) Assignee: Aruze Corporation, Tokyo (JP)

( * ) Notice: Subject to any disclaimer, the term of this patent is extended or adjusted under 35 U.S.C. 154(b) by 0 days.

(21) Appl. No.: 09/293,951

(22) Filed: Apr. 19, 1999

(30) Foreign Application Priority Data

Aug. 3, 1998 (JP) ..... 10-218755

(51) Int. Cl.[7] ..... G07F 17/34
(52) U.S. Cl. ..... 273/143 R; 463/20
(58) Field of Search ..... 273/143 R, 138.2; 463/20

(56) References Cited

U.S. PATENT DOCUMENTS 4,618,150 * 10/1986 Kimura ..... 273/143 R
5,018,737 * 5/1991 Okaka ..... 273/143 R
5,024,439 * 6/1991 Okada ..... 273/143 R
5,695,402 12/1997 Stupak .

FOREIGN PATENT DOCUMENTS 195 42 625 A1 2/1997 (DE) .
0 918 307 A 5/1999 (EP) .
2 100 905 A 1/1983 (GB) .
2156565 * 10/1985 (GB) ..... 273/143 R

* cited by examiner

*Primary Examiner*—Benjamin H. Layno
(74) *Attorney, Agent, or Firm*—Snider & Associates; Ronald R. Snider

(57) ABSTRACT

In a gaming machine displaying a plurality of rows of symbols in moving and stopped states, when the mode of symbols displayed in a stopped state is determined to be a big winning pattern, then the LEDs of credit meter 126, bet meter 120, and last bet meter 122 are turned off (S2 to S6). The timings at which these meters 120 to 126 are turned off are set such that they appear to turn off at substantially the same time to the player's eyes. Further, all of the reel section illuminating lamps 130A to 130I, disposed within the space on the inner peripheral side of reels 12A, 12B, and 12C are temporarily turned off (S7). As all of the LEDs of meters 120 to 126 and the reel section illuminating lamps 130A to 130I are turned off, the player is startled for an instant, so that the expectation for the game increases thereafter, whereby amusement can be enhanced.

9 Claims, 5 Drawing Sheets

GAMING MACHINE

RELATED APPLICATIONS

This application claims the priority of Japanese Patent Application No. 10-218755 filed on Aug. 3, 1998, which is incorporated herein by reference.

BACKGROUND OF THE INVENTION

1. Field of the Invention

The present invention relates to a gaming machine, such as slot machine, which displays a plurality of rows of symbols in moving and stopped states; and, in particular, to a gaming machine which provides a player with a predetermined gain when the mode of the rows of symbols displayed in a stopped state is a particular mode which is a predetermined combination of symbols, the front panel of the machine being equipped with a plurality of illuminating members such as lamps and/or LEDs, for example.

2. Description of the Prior Art

Among slot machines and some pachinko machines, there have been known gaming machines equipped with a reel apparatus having a plurality of reels, which stops the rotation of each reel after the lapse of a predetermined period of time from the starting of rotation or in response to a predetermined reel-stopping operation carried out by a player. In general, such a reel apparatus has the following configuration.

Namely, the plurality of reels are independently rotatable around the same axis, each of the reels having a plurality of symbols formed on the peripheral surface thereof in series along its circumferential direction. Upon a player's starting operation, the individual reels start rotating at the same time and, thereafter, sequentially stop such that at least one of the plurality of symbols aligns with an effective line disposed on display windows in front of the reels.

The symbols displayed on the display windows are determined by random number sampling carried out by a control unit accommodated in the gaming machine. Namely at the same time when each game is started or immediately thereafter, the control unit determines whether the play results in "winning" or not by comparing a value acquired by random number sampling with an award table prestored in a memory device. When the determination results in winning, then each reel is displayed in a stopped state such that a combination of symbols constructing a winning display mode aligns with the effective line of the display windows. On the other hand, when the determination does not result in winning, each reel is displayed in a stopped state such that a combination of symbols which does not construct any winning display mode aligns with the effective line of the display windows.

In the above-mentioned gaming machine, a particular combination of symbols, such as "7-7-7," called "big winning" which provides the player with a very big gain is predetermined in addition to usual winning modes. Players of such a gaming machine play games, while hoping for big winning.

Therefore, it has been desired that a special attraction be performed when the player's expected big winning is determined, in order to enhance the interest of the player.

In particular, so-called "auto-stop" type slot machines equipped with no stop button have been likely to give the impression that big winning simply occurs when the combination of symbols appearing on the display windows in front of the individual reels incidentally match a particular symbol pattern, so that the excitement of having attained big winning may not always be enough as compared with its expectation, thereby being unsatisfactory in terms of amusement.

SUMMARY OF THE INVENTION

In view of such circumstances, it is an object of the present invention to provide a gaming machine which can fully enhance the excitement of the player at the time of a predetermined winning mode, thereby improving amusement.

The gaming machine in accordance with the present invention is a gaming machine which displays a plurality of rows of symbols in a moving state at an image display section formed in a front panel, stops displaying the rows of symbols in the moving state thereafter, and gives a predetermined gain to a player when a mode of symbols displayed in thus stopped state coincides with a particular mode which is a predetermined combination of symbols, the gaming machine comprising:

symbol determination means for determining the mode of rows of symbols displayed in the stopped state at the image display section before the rows of symbols are displayed in the stopped state;

a plurality of illuminating members disposed on the front panel, which are turned on in a normal game; and panel section illuminating member control means for turning off the plurality of illuminating members disposed on the front panel when the mode of rows of symbols displayed in the stopped state is determined by the symbol determination means to be the particular mode.

Here, the above-mentioned "normal game" refers to a game other than games in which the mode of rows of symbols displayed in a stopped state is a predetermined combination of symbols.

Here, the above-mentioned "plurality of illuminating members disposed on the front panel" do not include illuminators for illuminating the rows of symbols within the image display section.

The gaming machine in accordance with the present invention may further comprise illuminator control means for temporarily turning off all the illuminators illuminating the rows of symbols within the image display section when the mode of rows of symbols displayed in the stopped state is determined by the symbol determination means to be the particular mode, and then turning on all the illuminators in response to a timing at which the plurality of rows of symbols are displayed in the stopped state.

Alternatively, the gaming machine in accordance with the present invention may sequentially display the plurality of rows of symbols in the stopped state and further comprise illuminator control means for blinking, in response to a timing at which each row of symbols is displayed in the stopped state, the illuminator illuminating the next row of symbols to be displayed in the stopped state, and turning on, in response to a timing at which all the rows of symbols are displayed in the stopped state, all the illuminators illuminating the rows of symbols.

In the gaming machine in accordance with the present invention, the panel section illuminating member control means may turn on the plurality of illuminating members disposed on the front panel in response to a timing at which the plurality of rows of symbols are displayed in the stopped state.

The gaming machine in accordance with the present invention may further comprise sound output means for outputting, when the mode of rows of symbols displayed in the stopped state is determined by the symbol determination means to be the particular mode, a sound different from the sound outputted in the normal game.

The illuminating members may be constituted by lamps and/or LEDs.

DESCRIPTION OF THE PREFERRED EMBODIMENTS

In the following, the gaming machine in accordance with an embodiment of the present invention will be explained with reference to the accompanying drawings.

Figure 2:
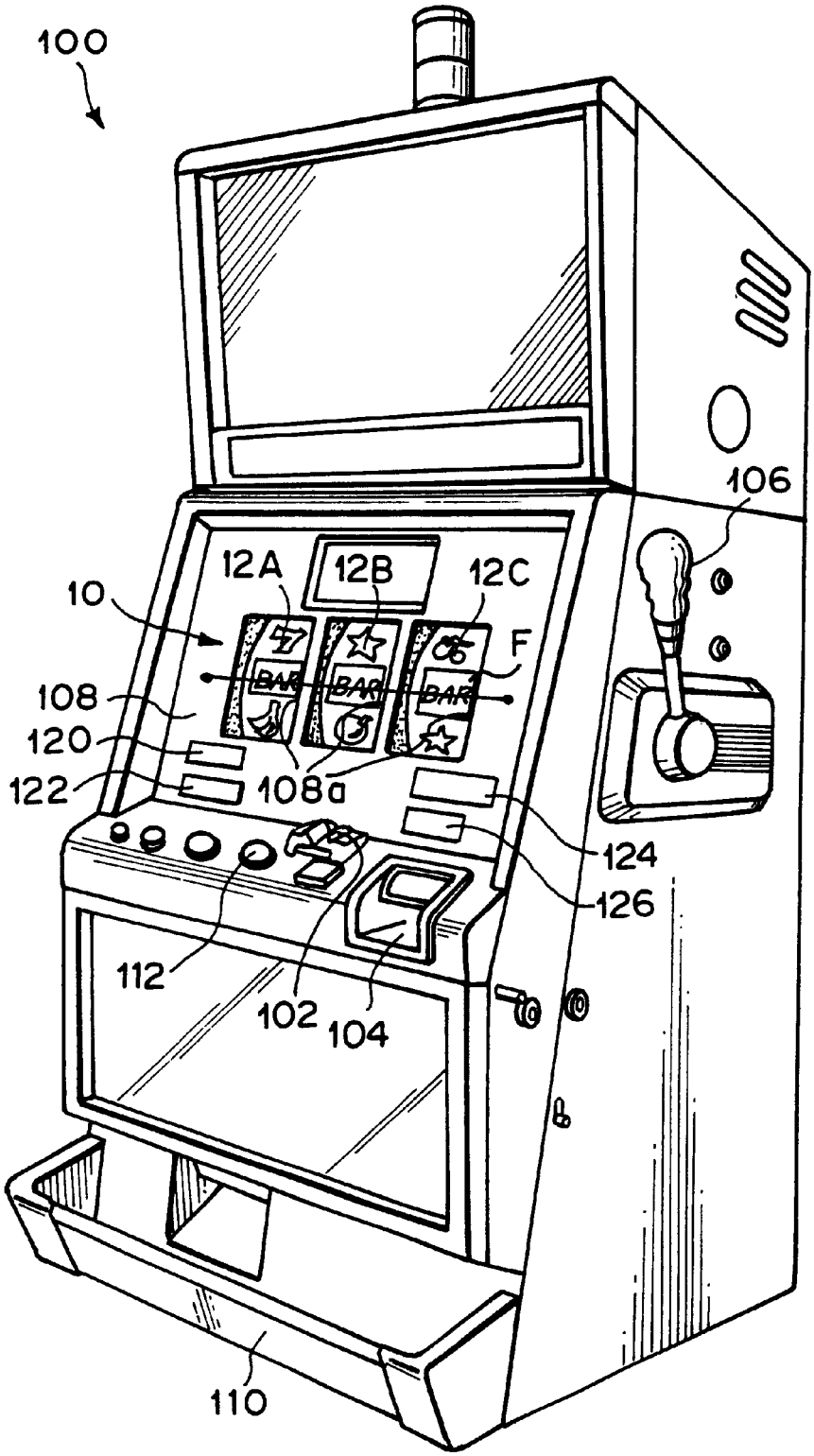
FIG. 2 is a perspective view showing the gaming machine in accordance with the above-mentioned embodiment.

FIG. 2 is a perspective view showing the gaming machine (slot machine) in accordance with this embodiment. As shown in FIG. 2, this slot machine 100 is an auto-stop-reel type slot machine, in which, when a handle lever 106 is pushed down toward the front side (or a spin button 112 is pushed) with cash being inserted in a coin entry 102 or bill entry 104, a reel apparatus 10 provided with a plurality of symbols F in series is actuated, so that its three reels 12A, 12B, and 12C simultaneously start rotating, and then the left reel 12A, the center reel 12B, and the right reel 12C sequentially stop rotating in this order.

Here, each of the reels 12A, 12B, and 12C stops rotating such that one of the plurality of symbols F aligns with an effective line disposed on three display windows 108*a* formed in a front panel 108.

If the combination of symbols F displayed at the effective line of the three display windows 108*a* when the reels 12A, 12B, and 12C are stopped matches a predetermined winning pattern, then coins will flow out to a coin tray 110 by the number corresponding to the winning pattern. If the combination of symbols F matches a predetermined big winning pattern among winning patterns, then a large number of coins corresponding to the big winning pattern will flow out to the coin tray 110.

In each of the reels 12A, 12B, and 12C, the part formed with the symbols F is made of a semitransparent member exhibiting diffuse transmissivity. Hence, the symbols F located at the display windows 108*a* are brightly illuminated from therebehind by reel section illuminating lamps 130A to 1301 which are illuminators disposed in the space on the inner periphery side of the reels 12A, 12B, and 12C.

Disposed below the left reel 12A are a bet meter 120 for displaying a bet number by seven segments, and a last bet meter 122 for displaying, by seven segments, the number bet in the last game. Disposed below the right reel 12C are a win meter 124 for displaying, by seven segments, the number of coins acquired until after the last game, and a credit meter 126 for displaying, by seven segments, the remaining number of credit. These meters 120 to 126 are always turned on in a normal game.

While a player thus enjoys excitement when acquiring winning, big winning particular, it is desirable that not only a large amount of coins be caused to flow out to the coin tray 110 but also a certain attraction be provided so as to further enhance the excitement of the player.

Here, the symbols displayed at the effective line of the display windows 108*a* are determined by random number sampling performed by a control unit accommodated in the gaming machine. At the same time when each game is started or immediately thereafter, the control unit determines whether the play results in winning or not by comparing a value acquired by random number sampling with an award table prestored in a memory device. When the determination results in winning, then each of the reels 12A, 12B, and 12C is displayed in a stopped state such that a combination of symbols F constructing a winning display mode aligns with the effective line of the display windows 108*a*. On the other hand, when the determination does not result in winning, each of the reels 12A, 12B, and 12C is displayed in a stopped state such that a combination of symbols which does not construct any winning display mode aligns with the effective line of the display windows 108*a*.

In such a gaming machine, as mentioned above, a particular combination of symbols F, such as "7-7-7," called "big winning" which provides the player with a very big gain is predetermined in addition to usual winning modes. Therefore, players play games, while hoping for big winning.

From such a viewpoint, the following attraction is performed at the time of big winning in this embodiment.

Immediately after each game is started, the above-mentioned control unit determines whether the play results in winning or not, and causes, when the determination results in winning, each of the reels 12A, 12B, and 12C to be displayed in a stopped state such that a combination of symbols F constructing a winning display mode aligns with the effective line of the display windows 108*a*. If the winning is big winning, then all of the seven-segment LEDs of the meters 120 to 126 disposed on the front panel 108 are turned off at a predetermined timing during the rotating period of the reels 12A, 12B, and 12C. Thereafter, at a timing when the reels 12A, 12B, and 12C are displayed in a stopped state so that the combination of symbols F constructing a big winning display mode aligns with the effective line of the display windows 108*a*, all the seven-segment LEDs of the meters 120 to 126 are turned on.

Figure 3:
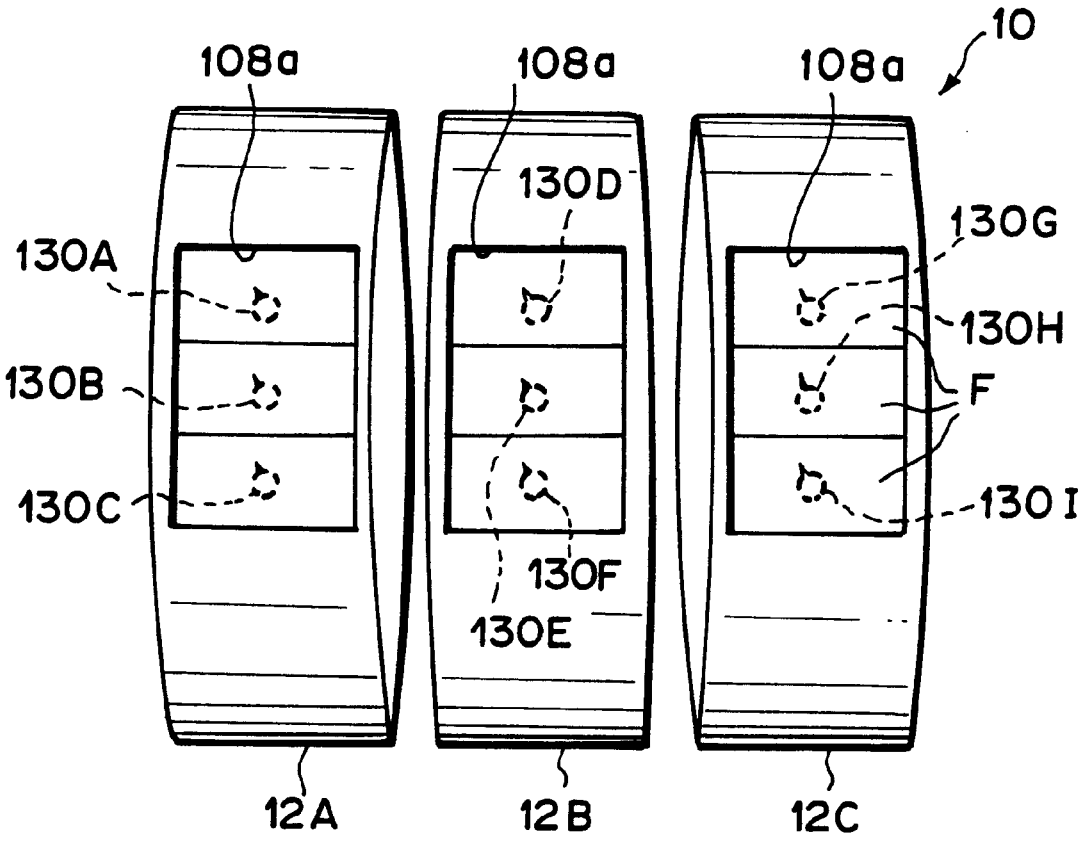
FIG. 3 is a schematic view showing, on an enlarged scale, the reel section of the gaming machine shown in FIG. 2.

As shown in FIG. 3, the symbols F located at the display windows 108*a* are brightly illuminated from therebehind by their corresponding reel section illuminating lamps 130A to 130I disposed in the space on the inner periphery side of the reels 12A, 12B, and 12C. If the play is determined by the control unit to be big winning, then all of the reel section illuminating lamps are temporarily turned off. Thereafter, every time any of the reels 12A, 12B, and 12C stops rotating, one of the reel section illuminating lamps 130A to 130I that illuminates the next one of the reels 12A, 12B, and 12C to stop rotating is blinked. When all the reels 12A, 12B, and 12C are displayed in a stopped state such that the combination of symbols F constructing a big winning display mode aligns with the effective line of the display windows 108*a*, then all the reel section illuminating lamps 130A to 130I are turned on.

Such an attraction is controlled by the control unit accommodated in the slot machine. A specific configuration of the control unit and a relationship between the control unit and external devices in terms of connection will be explained with reference to the block diagrams of FIGS. 4 and 5, whereas its operations will be explained with reference to the flowchart of FIG. 1.

Figure 4:
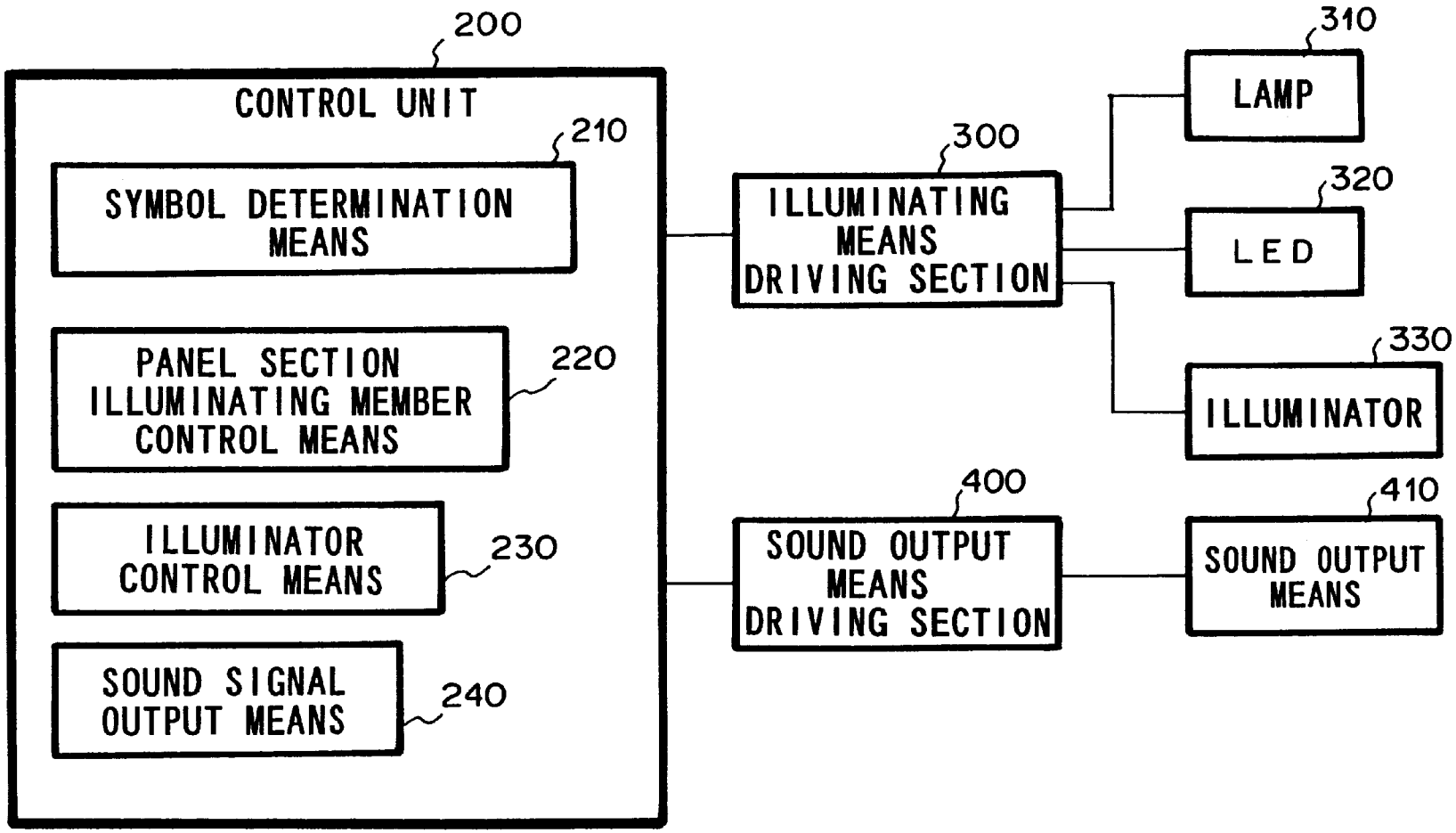
FIG. 4 is a block diagram showing main parts of the gaming machine in accordance with the above-mentioned embodiment.

As shown in the block diagram of FIG. 4, the control unit 200 comprises a symbol determination means 210, a panel section illuminating member control means 220, an illuminator control means 230, and a sound signal output means 240.

The symbol determination means 210 determines whether or not the mode of symbols displayed in a stopped state at the effective line of the display windows 108*a* is a winning or big winning mode of combination. If the mode is determined by the symbol determination means 210 to be a big winning mode, then the panel section illuminating member control means 220 outputs a turn-off signal for turning off, at a predetermined timing, the seven-segment LEDs of the meters 120 to 126 disposed on the front panel 108 and, thereafter, outputs a turn-on signal for turning on all the seven-segment LEDs of the meters 120 to 126 at a timing when the reels 12A, 12B, and 12C are displayed in a stopped state such that the combination of symbols F constructing a big winning display mode aligns with the effective line of the display windows 108*a*.

If the mode is determined by the symbol determination means 210 to be a big winning mode, then the illuminator control means 230 outputs a signal for commanding the reel section illuminating lamps 130A to 130I to turn off, blink, and turn on.

The command signal outputted from the illuminator control means 230 is fed into an illuminating means driving section 300. In response thereto, a lamp 310, an LED 320, and an illuminator 330 are selectively turned off, blinked, and turned on.

When the mode is determined by the symbol determination means 210 to be a big winning mode, then the sound signal output means 240 outputs a sound signal concerning a sound different from the sound output in a normal game or different from the sound output in a game corresponding a usual winning mode.

The sound signal outputted from the sound signal output means 240 is fed into a sound output means driving section 400. In response thereto, a sound peculiar to big winning is outputted from a sound output means (speaker) 410.

Figure 5:
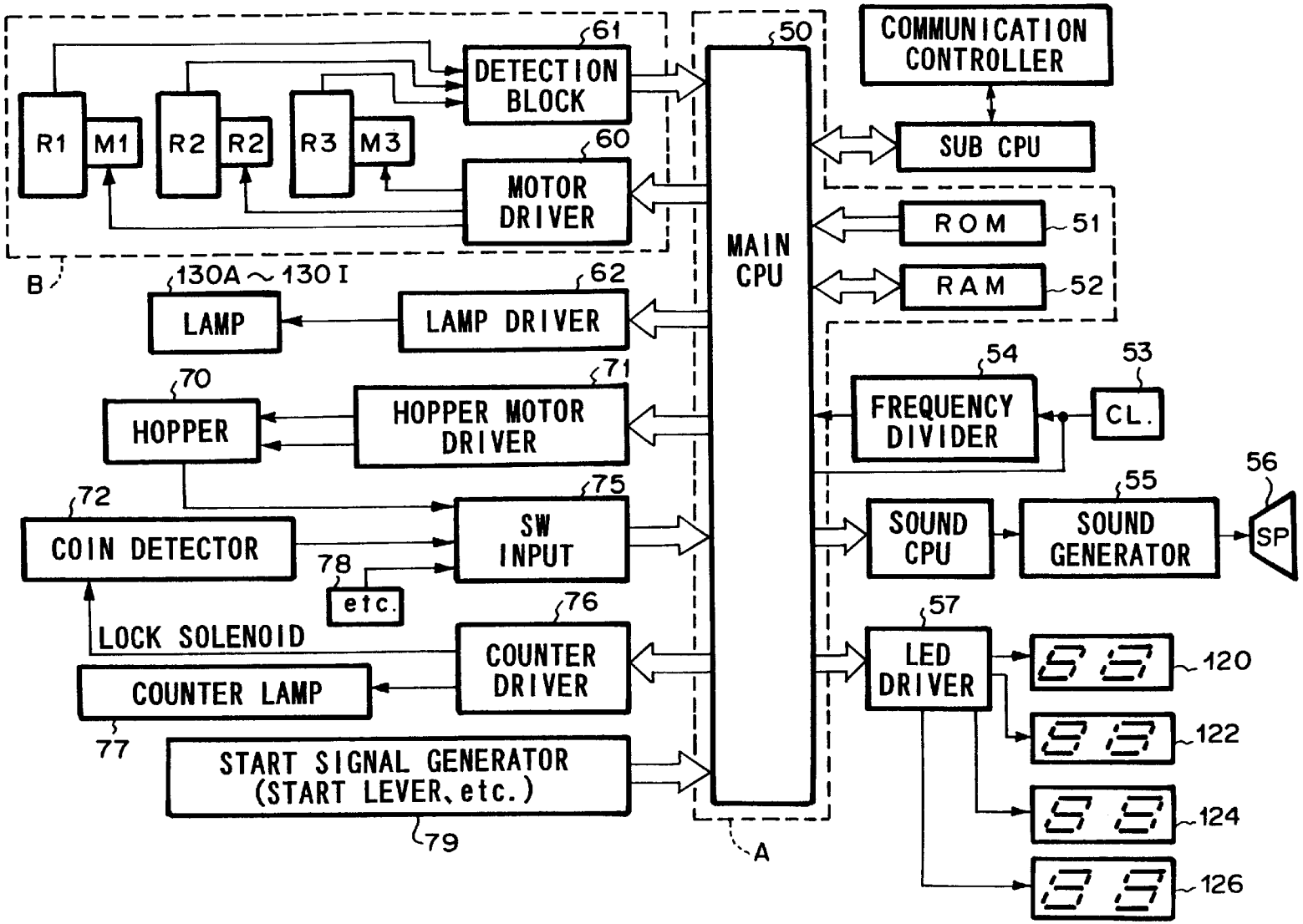
FIG. 5 is a block diagram showing the control unit and the like in the gaming machine in accordance with the above-mentioned embodiment.

In FIG. 5, a broken-line block A refers to a main control section including a main CPU 50, a ROM 51, and a RAM 52. The ROM 51 stores a table of correspondence between symbols F and their symbol codes, a table listing symbol codes corresponding to winning (including big winning) and numbers of winning coins to be paid out, a winning probability table corresponding to winning states used for winning an executed game, a table of correspondence between lamps to be turned on among the lamps (reel section illuminating lamps) 130A to 130I and their corresponding random numbers, and the like. On the other hand, the RAM 52 is provided with a random number bank for temporarily saving the value of random number sampled after starting the game, a table for temporarily storing data such as code numbers of the reels and symbol numbers, and the like.

Also provided are a clock pulse generator 53 for generating reference pulses of 4 MHz, for example, at which the main CPU 50 is operated, and a frequency divider 54 for supplying interrupt pulses of 500 MHz, for example, to the main CPU 50 so as to make it execute a predetermined program as an interrupt. Further provided are a speaker 56 usable as the above-mentioned sound output means 410, and a sound CPU and a sound generator 55, which are usable as the above-mentioned sound signal output means 240 and sound output means driving section 400, driven so as to generate a sound from the speaker 56. Also disposed is an LED driver 57 (constituting the illuminating means driving section 300 together with a lamp driver 62) for driving the individual meters 120 to 126 made of LEDs for displaying seven segments.

A broken-line block B refers to a reel driving monitor block. The individual reels R1 (12A), R2 (12B), and R3 (12C) are driven by pulse motors M1, M2, and M3, respectively. The pulse motors M1, M2, and M3 are rotated by drive pulses supplied from a motor driver 60. For example, the reels R1 (12A), R2 (12B), and R3 (12C) are rotated such that their symbols F seen through the display windows 10*a* shift one by one in response to a predetermined number of pulses. Also, the reels R1 (12A), R2 (12B), and R3 (12C) are configured so as to generate a reset signal per one revolution. A detection block 61 detects this reset signal. After the reset signal is detected by the detection block 61, the main CPU 50 counts the numbers of driving pulses supplied to the pulse motors M1, M2, and M3, whereby the kinds of symbols F seen through the display windows 108*a* can be specified.

Also provided is the lamp driver 62, which chooses, upon a command from the main CPU 50, any of the reel section illuminating lamps 130A to 130I (corresponding to the illuminator 330) and selectively turns on, blinks, and turns off thus chosen lamp.

Further provided are a hopper 70 for paying out winning coins and a hopper motor driver 71. Also provided is a coin detector 72 for detecting insertion of coins before starting the game. Together with the payout coin number signal from the hopper 70, the insertion coin number signal from the coin detector 72 is transmitted from a counter driver 76 to a counter or lamp 77 via a switch input section 75 and the main CPU 50, whereby the number of inserted coins and the number of payout coins are detected, or the reel section illuminating lamps 130A to 130I for the winning effective line are turned on in response to the number of inserted coins. Here, when the number of inserted coins reaches a predetermined number, then a lock solenoid for blocking the coin insertion is driven.

Further provided is another switch operating section 78 such as an abort switch which is operated when the game is to be aborted. Also provided is a start signal generator 79 which is constituted, for example, by the above-mentioned handle lever 106, spin button 112, and the like.

Figure 1:
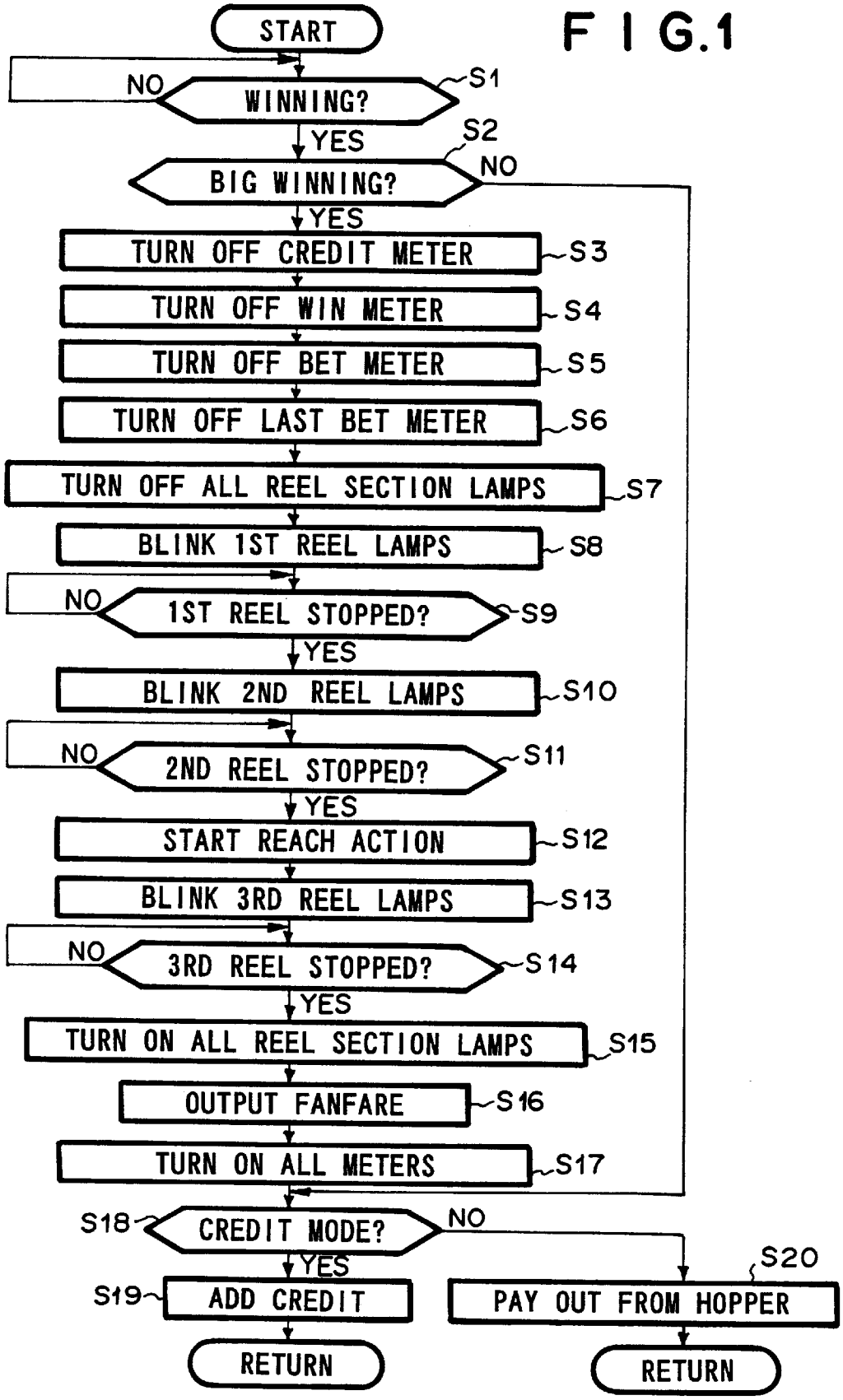
FIG. 1 is a flowchart for explaining an attraction processing operation in the gaming machine in accordance with an embodiment of the present invention.

The attraction processing of the above-mentioned main CPU 50 at the time of big winning will now be explained with reference to FIG. 1.

First, at the initial step of a routine, whether it is winning or not is determined (S1). If the determination results in winning, then whether it is big winning or not is determined (S2). If the determination results in big winning, then the LED of the credit meter 126 is turned off (S3), the LED of the win meter 124 is turned off (S4), the LED of the bet meter 120 is turned off (S5), and the LED of the last bet meter 122 is turned off (S6). The turn-off timings of the respective LEDs of the meters 120 to 126 are set such that they appear to turn off at substantially the same time to the player's eyes.

Further, all the reel section illuminating lamps 130A to 130I, disposed within the space on the inner periphery side of the reels 12A, 12B, and 12C, corresponding to the respective symbols F are temporarily turned off (S7).

As all of the LEDs of the meters 120 to 126 and the reel section illuminating lamps 130A to 130I are turned off, the player is startled for an instant, so that the expectation for the game increases thereafter, whereby amusement can be enhanced.

Subsequently, the reel section illuminating lamps 130A to 130C for the left reel (1st reel) 12A are blinked (S8), and then whether the rotation of the left reel (1st reel) 12A is stopped or not is determined (S9).

If the rotation of the left reel (1st reel) 12A is determined to be stopped, then the reel section illuminating lamps 130D to 130F for the center reel (2nd reel) 12B are blinked (S10), and thereafter whether the rotation of the center reel (2nd reel) 12A is stopped or not is determined (S11).

If the rotation of the center reel (2nd reel) 12B is determined to be stopped, then a reach action is started (S12), and the reel section illuminating lamps 130G to 130I for the right reel (3rd reel) 12C are blinked (S13).

During the period in which the reels 12A, 12B, and 12C sequentially stop rotating, the expectation of the player becomes higher as the reels 12A, 12B, and 12C stop rotating. During this period, by turning off the LEDs of the meters 120 to 126 and blinking the reel section illuminating lamps 130A to 130I, only the symbols F appearing at the display windows 108 can be highlighted, so that an attraction for enhancing the interest of the player can be produced, whereby the amusement of the player can be improved.

Thereafter, whether the rotation of the right reel (3rd reel) 12C is stopped or not is determined (S14). If the rotation of the right reel (3rd reel) 12C is determined to be stopped (so that a big winning symbol pattern stops at the effective line), then all the reel section illuminating lamps 130A to 130I are turned on (S15). Together therewith, a predetermined sound output command signal is sent from the main CPU 50 to the sound generator 55 via the sound CPU, and a speaker driving signal outputted from the sound generator 55 in response to the sound output command signal causes the speaker 56 to output a fanfare peculiar to big winning (S16). At substantially the same time therewith, the LEDs of all the meters 120 to 126 are turned on (S17).

Thereafter, whether it is a credit mode or not is determined (S18). If it is determined to be the credit mode, an addition to the credit is made (S19). If not, coins are paid out from the hopper 70 (S20).

If it is determined not to be big winning at the above-mentioned step 2 (S2), then the flow directly proceeds to step 18 (S18).

Though all of the LEDs of the meters 120 to 126 and the respective reel section illuminating lamps 130A to 130I corresponding to the symbols F are temporarily turned off if the determination results in big winning in the above-mentioned embodiment, other lamps and LEDs disposed on the front panel 108 may additionally be turned off together therewith. As a consequence, the attraction of the slot machine in a relatively dark hall can further be highlighted.

Also, though the right reel 12C stops rotating at last in the above-mentioned embodiment, the center reel 12B may stop rotating at last.

The attraction is desirably performed such that, within the front panel 108, only the reels 12A, 12B, and 12C to which the player pays attention are brightly highlighted.

Also, for example, the reel section illuminating lamps 130G to 1301 for the right reel (3rd reel) 12C that stops rotating at last may sequentially repeat blinking. As a consequence, the player's expectation for big winning can further be enhanced.

Though the attraction is performed in the above-mentioned embodiment so as to blink the reel section illuminating lamps 130A to 130I, they can be turned on without blinking after being once turned off.

Also, the sound peculiar to big winning may be generated at the time when the reels 12A, 12B, and 12C are rotated.

Though the gaming machine in accordance with the present invention is particularly effective when applied to so-called auto-stop type slot machines, it is also applicable to other gaming machines such as slot machines and pachinko machines of a type in which a player can manipulate the timing at which each reel stops rotating, as a matter of course.

As the gaming machine in accordance with the present invention is configured such that a plurality of lamps and/or LEDs disposed on the front panel of the gaming machine are turned off when the mode of rows of symbols displayed in a stopped state is determined by the symbol determination means to be a particular mode, the player is startled for an instant, and the expectation for the game increases thereafter, whereby amusement can be enhanced.

During the period in which the reels sequentially stop rotating, the expectation of the player becomes higher as the reels stop rotating. During this period, by performing an attraction such that only the symbols F appearing at the display windows in the front panel are highlighted by reel section illuminating lamps, the amusement of the player can be improved.

What is claimed is:

1. A gaming machine which displays a plurality of rows of symbols in a moving state at an image display section formed in a front panel, stops displaying said rows of symbols in the moving state thereafter, and gives a predetermined gain to a player when a mode of symbols displayed in thus stopped state coincides with a particular mode which is a predetermined combination of symbols, said gaming machine comprising:

symbol determination means for determining said mode of rows of symbols displayed in the stopped state at said image display section before said rows of symbols are displayed in the stopped state;

a plurality of illuminating members disposed on said front panel, which are turned on in a normal game; and panel section illuminating member control means for turning off said plurality of illuminating members disposed on said front panel when said mode of rows of symbols displayed in the stopped state is determined by said symbol determination means to be said particular mode.

2. A gaming machine according to claim 1, further comprising illuminator control means for temporarily turning off all illuminators illuminating said rows of symbols within said image display section when said mode of rows of symbols displayed in the stopped state is determined by said symbol determination means to be said particular mode, and then turning on all said illuminators in response to a timing at which said plurality of rows of symbols are displayed in the stopped state.

3. A gaming machine according to claim 2, wherein said panel section illuminating member control means turns on said plurality of illuminating members disposed on said front panel in response to a timing at which said plurality of rows of symbols are displayed in the stopped state.

4. A gaming machine according to claim 2, further comprising sound output means for outputting, when said mode of rows of symbols displayed in the stopped state is determined by said symbol determination means to be said particular mode, a sound different from the sound outputted in said normal game.

5. A gaming machine according to claim 2, wherein said illuminating members are constituted by lamps and/or LEDs.

6. A gaming machine according to claim 1, wherein said plurality of rows of symbols are sequentially displayed in the stopped state, said gaming machine further comprising illuminator control means for blinking, in response to a timing at which each row of symbols is displayed in the stopped state, an illuminator illuminating the next row of symbols to be displayed in the stopped state, and turning on, in response to a timing at which all said rows of symbols are displayed in the stopped state, all illuminators illuminating said rows of symbols.

7. A gaming machine according to claim 6, wherein said panel section illuminating member control means turns on said plurality of illuminating members disposed on said front panel in response to a timing at which said plurality of rows of symbols are displayed in the stopped state.

8. A gaming machine according to claim 6, further comprising sound output means for outputting, when said mode of rows of symbols displayed in the stopped state is determined by said symbol determination means to be said particular mode, a sound different from the sound outputted in said normal game.

9. A gaming machine according to claim 6, wherein said illuminating members are constituted by lamps and/or LEDs.

* * * * *